US006817409B2

(12) United States Patent
Howard

(10) Patent No.: US 6,817,409 B2
(45) Date of Patent: Nov. 16, 2004

(54) DOUBLE-ACTING RECIPROCATING DOWNHOLE PUMP

(75) Inventor: William F. Howard, West Columbia, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 65 days.

(21) Appl. No.: 10/167,622

(22) Filed: Jun. 12, 2002

(65) Prior Publication Data

US 2002/0189805 A1 Dec. 19, 2002

Related U.S. Application Data

(60) Provisional application No. 60/298,161, filed on Jun. 13, 2001.

(51) Int. Cl.[7] ..... E21B 34/00

(52) U.S. Cl. ..... 166/108; 166/165; 166/334.1; 417/418; 417/555.2

(58) Field of Search ..... 166/68, 68.5, 107, 166/108, 105, 165, 332.1, 334.1; 417/416–418, 555.2, 554

(56) References Cited

U.S. PATENT DOCUMENTS

| | | | | |
|---|---|---|---|---|
| 1,549,175 A | | 8/1925 | Adams et al. | |
| 2,684,639 A | * | 7/1954 | Sutton | 417/448 |
| 3,945,774 A | * | 3/1976 | Doan | 417/554 |
| 4,548,552 A | | 10/1985 | Holm | 417/417 |
| 4,562,385 A | | 12/1985 | Rabson | 318/135 |
| 4,687,054 A | | 8/1987 | Russell et al. | 166/66.4 |
| 4,815,949 A | | 3/1989 | Rabson | 417/417 |
| 4,936,383 A | | 6/1990 | Towner et al. | |
| 5,196,770 A | | 3/1993 | Champs et al. | 318/135 |
| 5,252,043 A | | 10/1993 | Bolding et al. | 417/417 |
| 5,314,025 A | * | 5/1994 | Priestly | 166/105 |
| 5,431,229 A | * | 7/1995 | Christensen | 166/369 |
| 5,620,048 A | | 4/1997 | Beauquin | 166/62 |
| 5,657,821 A | | 8/1997 | Beauquin et al. | |
| 5,734,209 A | | 3/1998 | Hallidy | 310/12 |
| 5,831,353 A | | 11/1998 | Bolding et al. | 310/12 |
| 5,960,875 A | | 10/1999 | Beauquin et al. | |
| 6,138,763 A | | 10/2000 | Beauquin | |
| 6,176,308 B1 | | 1/2001 | Pearson | 166/65.1 |
| 6,203,288 B1 | | 3/2001 | Kottke | 417/328 |
| 6,213,722 B1 | | 4/2001 | Raos | 417/53 |
| 6,250,384 B1 | | 6/2001 | Beauquin | |
| 6,283,720 B1 | | 9/2001 | Kottke | 417/53 |
| 6,288,470 B1 | | 9/2001 | Breit | 310/254 |
| 6,289,575 B1 | | 9/2001 | Hollingsworth et al. | 29/596 |
| 2002/0079763 A1 | | 6/2002 | Fleshman et al. | 310/87 |
| 2002/0197174 A1 | | 12/2002 | Howard | |

FOREIGN PATENT DOCUMENTS

| | | | |
|---|---|---|---|
| FR | 2 385 911 | 10/1978 | F04B/17/00 |
| GB | 1 442 737 | 7/1976 | F04B/17/04 |

* cited by examiner

*Primary Examiner*—David Bagnell
*Assistant Examiner*—Matthew J. Smith
(74) *Attorney, Agent, or Firm*—Moser, Patterson & Sheridan, L.L.P.

(57) ABSTRACT

A positive displacement pump for pumping fluids from a downhole formation to the earth's surface is provided. The pump first comprises a plunger. The plunger is reciprocated axially within the wellbore by a linear actuator, such as a submersible electrical pump, in order to form an upstroke and a downstroke. A pump inlet is disposed near the bottom end of the plunger, while a pump outlet is disposed near the top end of the plunger. The pump is configured such that it is able to pump a first volume of fluid upward within the wellbore during the pump's upstroke, and a second volume of fluid upward within the wellbore during the pump's downstroke. Thus, the pump is "double-acting."

28 Claims, 3 Drawing Sheets

DOUBLE-ACTING RECIPROCATING DOWNHOLE PUMP

CROSS-REFERENCE TO RELATED APPLICATIONS

This application claims priority to a pending provisional patent application entitled "Double-Acting Reciprocating Downhole Pump." That provisional application was filed on Jun. 13, 2001, and was assigned Ser. No. Prov. 60/298,161.

BACKGROUND OF THE INVENTION

1. Field of the Invention

This invention relates to pumping apparatus for transporting fluids from a well formation to the earth's surface. More particularly, the invention pertains to a double-acting, reciprocating downhole pump.

2. Description of the Related Art

Many hydrocarbon wells are unable to produce at commercially viable levels without assistance in lifting formation fluids to the earth's surface. In some instances, high fluid viscosity inhibits fluid flow to the surface. More commonly, formation pressure is inadequate to drive fluids upward in the wellbore. In the case of deeper wells, extraordinary hydrostatic head acts downwardly against the formation, thereby inhibiting the unassisted flow of fluid to the surface.

A common approach for urging production fluids to the surface includes the use of a mechanically actuated, positive displacement pump. Mechanically actuated pumps are sometimes referred to as "sucker rod" pumps. The reason is that reciprocal movement of the pump necessary for positive displacement is induced through reciprocal movement of a string of sucker rods above the pump from the surface.

A sucker rod pumping installation consists of a positive displacement pump disposed within the lower portion of the production tubing. The installation includes a piston which is moved in linear translation within the tubing by means of steel or fiberglass rods. Linear movement of the sucker rods is imparted from the surface by a rocker-type structure. The rocker-type structure serves to alternately raise and lower the sucker rods, thereby imparting reciprocating movement to the piston within the pump downhole.

Certain difficulties are experienced in connection with the use of sucker rods. The primary problem is rooted in the fact that most wells are not truly straight, but tend to deviate in various directions en route to the zone of production. This is particularly true with respect to wells which are directionally drilled. In this instance, deviation is intentional. Deviations in the direction of a downhole well cause friction to occur between the sucker rod and the production tubing. This, in turn, causes wear on the sucker rod and the tubing, necessitating the costly replacement of one or both. Further, the friction between the sucker rod and the tubing wastes energy and requires the use of higher capacity motors at the surface.

In an attempt to overcome this problem, submersible electrical pumps have been developed. These pumps are installed into the well itself, typically at the lower end of the production tubing. State of the art submersible electrical pumps comprise a cylindrical assembly which resides at the base of the production string. The pump includes a rotary electric motor which turns turbines at a high horsepower. These turbines are placed below the producing zone of a well and act as fans for forcing production fluids upward through the production tubing.

Efforts have been made to develop a linear electric motor for use downhole. One example is U.S. Pat. No. 5,252,043, issued to Bolding, et al., entitled "Linear Motor-Pump Assembly and Method of Using Same." Other examples include U.S. Pat. No. 4,687,054, issued in 1987 to Russell et al. entitled "Linear Electric Motor For Downhole Use," and U.S. Pat. No. 5,620,048, issued in 1997, and entitled "Oil-Well Installation Fitted With A Bottom-Well Electric Pump." In these examples, the pump includes a linear electric motor having a series of windings which act upon an armature. The pump is powered by a cable extending from the surface to the bottom of the well, and residing in the annular space between the tubing and the casing. The power supply generates a magnetic field within the coils which, in turn, imparts an oscillating force upon the armature. In the case of a linear electric motor, the armature would be translated in an up-and-down fashion within the well. The armature, in turn, imparts translational movement to a piston, or connector shaft, residing below the motor. The linear electric motor thus enables the piston of a positive displacement pump to reciprocate vertically, thereby enabling fluids to be lifted with each stroke of the piston.

Submersible pump assemblies which utilize a linear electric motor have not been introduced to the oil field in commercially significant quantities. Such pumps would suffer from several challenges, if employed. One such relates to the volume of fluids which can be lifted with each stroke. In this respect, the typical positive displacement pump will only capture fluids on either the upstroke or the downstroke, depending on its design. Most commonly, fluids are captured, or "gulped," on the downstroke, with the captured volume of fluid flowing through a pump outlet at the top of the pump and then being lifted on the upstroke. Therefore, current positive displacement pumps are considered single acting, and not double-acting. Stated another way, fluid is only captured during a single phase of the stroke, and not during both phases of the stroke.

One obstacle encountered with the design of pumps pertains to hydrostatic balancing. In order to maximize efficiency of a motor apparatus for reciprocating a downhole pump, it is desirable that the pump be hydrostatically balanced. This means that the force required to move the pumping chamber on the upstroke is essentially the same as that required to move the pumping chamber back down on the down stroke. In the typical rocker-beam type lifting arrangement, the downhole pump is biased downward due to the action of hydrostatic head against the pump. Thus, the motor employed for lifting fluids via reciprocation of sucker rods requires that the motor have the capacity to lift a full column of fluid on the upstroke. The pump then simply falls back down on the downstroke in response to the weight of the sucker rods. Therefore, a linear electrical pump design which provides for hydrostatic balancing is desirable so that the force of the pump acting upward is used to displace fluids rather than to purely overcome the hydrostatic pressure differential.

In view of the above discussion, it is apparent that a more effective positive displacement pump is needed in order to transport formation fluids through the production tubing and to the earth's surface. In addition, a reciprocating pump is needed which is double-acting, that is, it is able to displace fluids both on the down stroke and on the upstroke. Further, a downhole pump is needed which permits the capture of a greater volume of fluids without a corresponding increase in velocity of the fluids through the pump. Further still, a linear pump is needed that is substantially hydrostatically balanced.

SUMMARY OF THE INVENTION

A positive displacement pump for pumping fluids from a downhole formation to the earth's surface is provided. The pump first comprises a hollow plunger. The plunger is reciprocated axially within the wellbore by a linear actuator, such as a submersible linear electric motor, in order to form an upstroke and a downstroke. A pump inlet is disposed at the bottom end of the plunger, while a pump outlet is disposed at the top end of the plunger. The pump is configured such that it is able to pump a first volume of fluid upward within the production tubing during the pump's upstroke, and a second volume of fluid upward within the tubing during the pump's downstroke. Thus, the pump is "double-acting."

In one embodiment, the piston resides within a tubular housing. A piston is positioned in the annular region between the hollow plunger and the housing. The piston is connected to the plunger, and moves up and down with the plunger. Upper and lower housing heads are also placed in the housing annulus, with the upper housing head fixedly residing above the piston, and the lower housing head fixedly residing below the piston. One or more ports are provided in the piston between the plunger and the lower housing head.

On the upstroke of the plunger, formation fluids are drawn (1) through the inlet port, (2) into the bore of the plunger, and (3) into the housing annulus below the piston. On the downstroke, formation fluids are (1) expelled from the housing annulus, (2) up through the outlet port, and (3) up the production tubing towards the surface. Thus, the pump is able to positively displace formation fluids on both the up stroke and the down stroke of the pump.

A second, alternative embodiment for a double-acting pump is also provided. In the second embodiment, the same inlet and outlet configurations are utilized, and the same seal configurations are used. However, in the second embodiment, a sleeve is nested between the plunger and the housing. Thus, a separate sleeve annulus and housing annulus are created.

In the second embodiment, a through-opening is also provided through the sleeve between the upper sleeve head and the piston. In this manner, fluid communication is attained between the housing annulus and the sleeve annulus. A second pump inlet and pump outlet are also provided in the housing annulus to define a second path of fluid flow. Thus, two possible flow paths for production fluids are provided—one through the plunger, and one through the housing annulus.

In the second embodiment, the upper sleeve annulus is pressurized during the upstroke, and fluid is pumped through both the sleeve through-opening and through the check valve at the second pump outlet. While the upper sleeve annulus is pumping, the lower sleeve annulus is depressurized to inlet pressure. As its volume increases, it pulls a relative vacuum and fills with fluid. Fluid enters through the inlet check valve at the lower end of the plunger. During the downstroke, the lower sleeve annulus pressurizes and fluid flows out of the lower sleeve annulus and up through the check valve at the first outlet, located at the upper end of the plunger. The check valve at the lower end of the plunger is forced to its closed position during this portion of the pumping cycle. At the same time, the second check valve at the upper portion of the housing annulus also closes, and the upper sleeve annulus increases in volume and draws fluid in through the second inlet at the lower end of the housing annulus. In this manner, the lower sleeve annulus is pumping and the upper sleeve annulus is filling during a first phase pump cycle, and they reverse roles during the second phase of the pump cycle.

BRIEF DESCRIPTION OF THE DRAWINGS

So that the manner in which the features of the present invention are attained and can be understood in detail, a more particular description of the invention, briefly summarized above, may be had by reference to the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
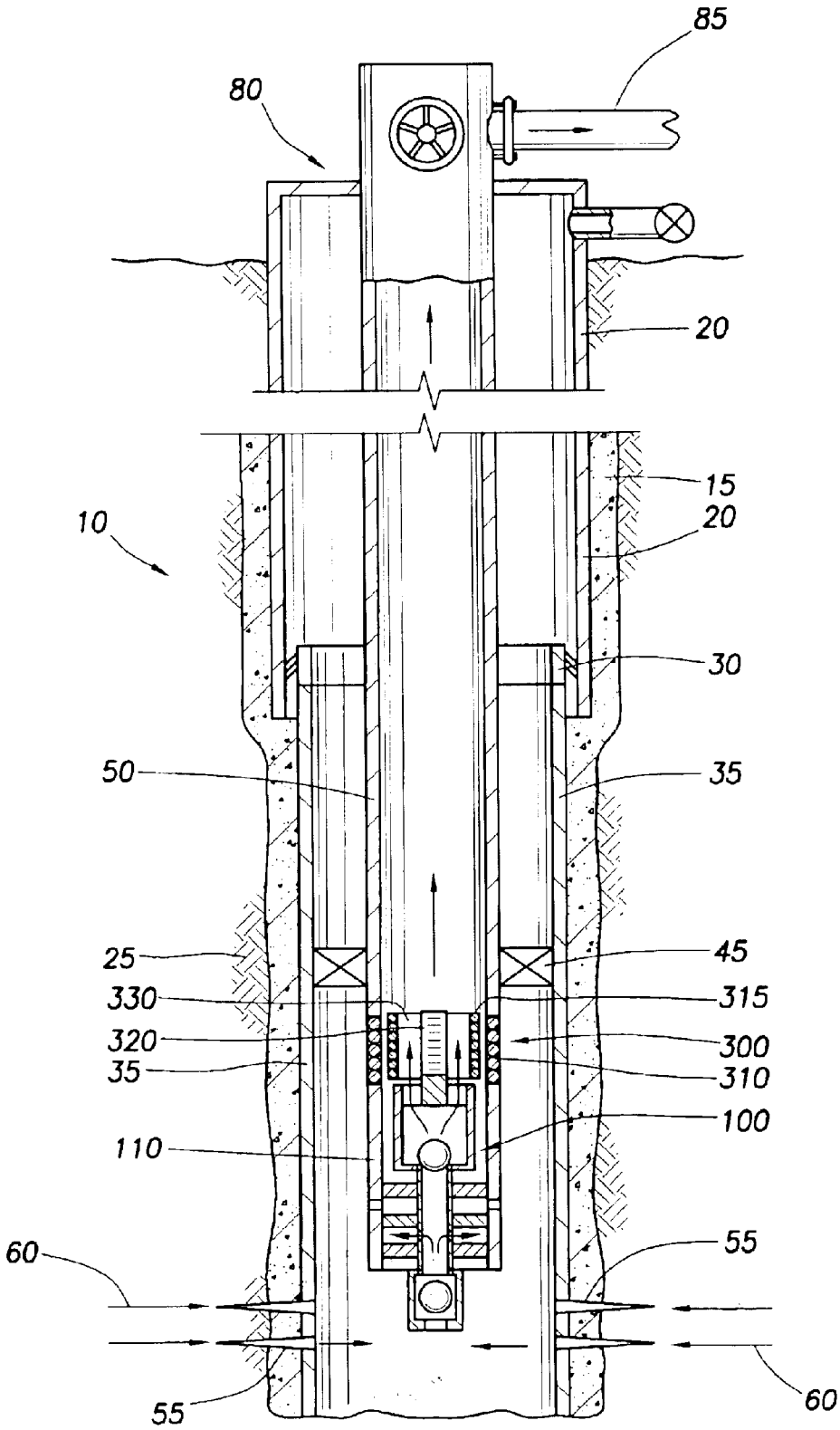
FIG. 1 presents a cross-sectional view of a wellbore. Disposed at the lower end of the wellbore is a double-acting, reciprocating downhole pump. In this arrangement, the pump is being reciprocated via an electric motor.

FIG. 1 presents a cross-sectional view of a wellbore 10. As completed in FIG. 1, the wellbore 10 has a first string of surface casing 20 hung from the surface. The first string 20 is fixed in the formation 25 by cured cement 15. A second string of casing 35 is also visible in FIG. 1. The second casing string 35, sometimes referred to as a "liner," is hung from the surface casing 20 by a conventional liner hanger 30. The liner hanger 30 employs slips which engage the inner surface of the surface casing 20 to form a frictional connection. The liner 35 is also cemented into the wellbore 10 after being hung from the surface casing 20.

The wellbore 10 is shown in a state of production. First, the liner 35 has been perforated in order to provide fluid communication between the wellbore 10 and a producing zone in the formation 25. Perforations may be seen at 55. Arrows 60 depict the flow of hydrocarbons into the wellbore 10. Second, a string of production tubing 50 is shown. The production tubing 50 provides a path for hydrocarbons to travel to the surface of the wellbore 10. A packer 45 is optionally positioned within the tubing 50 in order to seal the annular region between the tubing 50 and the liner 35.

A wellhead 80 is shown at the surface. The wellhead 80 is presented somewhat schematically. The wellhead 80 receives production fluids, and forwards them downstream through a flow line 85. Formation fluids are then separated, treated and refined for commercial use. It is understood that various components of a conventional wellhead and separator facilities are not shown in FIG. 1.

The wellbore 10 in FIG. 1 also includes a double-acting, reciprocating downhole pump 100 of the present invention, in a first embodiment. In this view, the pump 100 is being reciprocated via a submersible, electrical motor 300. At the moment shown in FIG. 1, the pump 100 is in its upstroke. Arrows again depict the flow of production fluids into the pump 100 and up the tubing string 50.

Figure 2:
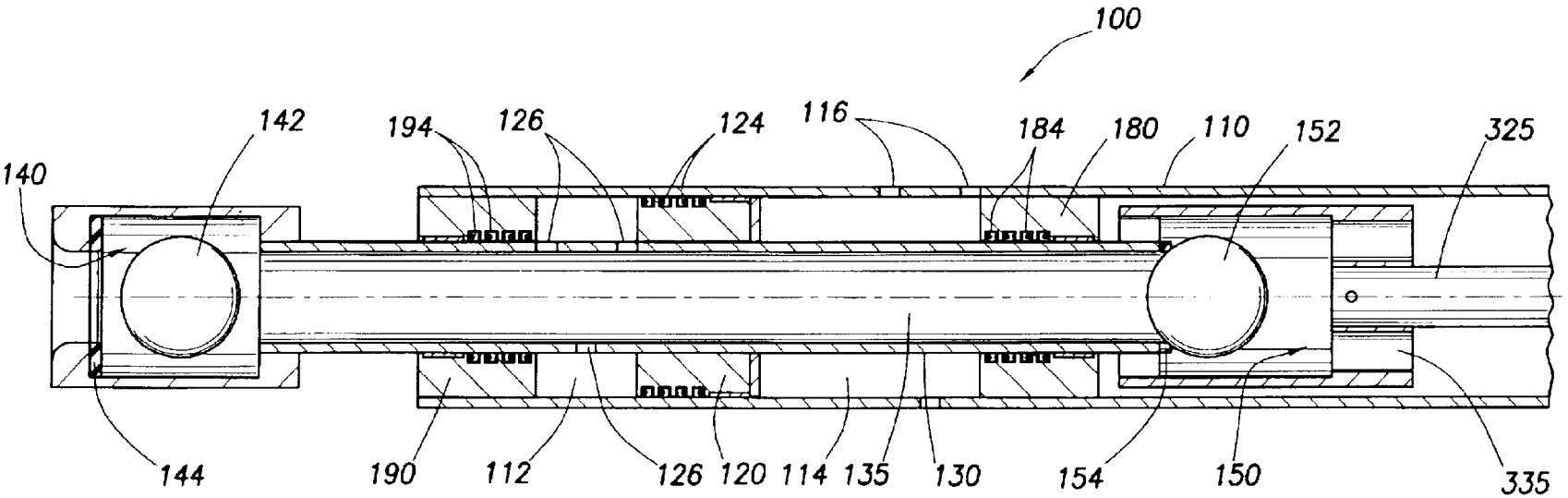
FIG. 2 presents a cross-sectional view of a first embodiment of a doubleacting, reciprocating downhole pump.

The pump 100 of FIG. 1 is shown in greater detail in FIG. 2. FIG. 2 presents the pump 100 in the first embodiment in a cross-sectional view. As shown in FIG. 2, the pump 100 first comprises a pump housing 110. The housing 110 may be the bottom portion of the production tubing 50, i.e. the tailpipe, or may define a separate tubular housing connected to the tail pipe (or other lower joint) of the production string. In the arrangement of FIGS. 1 and 2, the housing 110 defines a separate tubular body in series with the production tubing 50.

Within the pump housing 110 is a plunger 130. The plunger 130 reciprocates along the longitudinal axis of the housing 110 in response to movement imparted by a linear actuator 300 (not shown in FIG. 2). In this way, an upstroke and a downstroke of the pump 100 is produced.

The linear actuator 300 may be mechanically driven, such as a sucker rod (not shown) moving in response to a rocker-type structure at the surface. Alternatively, the linear actuator may be a rotary pump designed to convert rotary motion into linear motion, or even a motor at the surface having a piston extending into the borehole. In the arrangement of FIG. 1, the linear actuator 300 is electrically driven, and defines a linear submersible electrical pump residing downhole.

Various arrangements for a submersible electrical motor are known for driving a submersible pump. Typically, a linear motor comprises a stator portion and an armature. In FIG. 1, the stator is shown at 310 as a series of windings. The stator 310 is placed in series immediately below the tubing 50. The armature is shown somewhat schematically at 320, and represents a cylinder reciprocated by series of magnets 315. The magnets 315 react to an alternating current placed within the stator 310, which creates alternating positive and negative magnetic fields. The result is that the armature 320 is caused to reciprocate up and down within the tubing 50.

In the arrangement for the linear actuator 300 shown in FIG. 1, a flow channel 330 is provided within the bore of the armature 320. The channel 330 allows production fluids to move upward from the pump 100 to the production line 85 at the surface.

Those of ordinary skill in the art will appreciate that there are multiple arrangements for an electrical motor as placed within a hydrocarbon or other wellbore. The utility of the pumps of the present invention is not limited by the configuration or type of motor employed. Further, and as noted above, the pumps of the present invention may be reciprocated by a traditional mechanical rocker-and-sucker-rod arrangement. Thus, the term "linear actuator" includes any arrangement whereby reciprocating linear motion is imparted to the hollow plunger 130.

Another such example includes the use of coiled tubing (not shown) to impart reciprocal movement. In such an arrangement, a downhole motor is not employed; instead, a string of coiled tubing is run into the string of production tubing from the surface. The top end of the coiled tubing is connected to a mechanical rocker or other reciprocating device at the surface. The lower end of the coiled tubing, in turn, is connected to the hollow plunger 130 for transmitting the reciprocal motion. The outer housing 110 of the pump 100 would be connected to the production tubing. Alternatively, coiled tubing may replace the separate string of production tubing. In this arrangement, the outer housing 110 of the pump 100 would be connected to the wellbore casing 35 or a packer 45. In either arrangement, production fluids would be urged by the pump 100 up the coiled tubing string and/or the production tubing.

Referring again to FIG. 2, the plunger 130 has an upper end and a lower end. An elongated bore 135 is formed within the plunger 130. At the upper end of the plunger 130 is a connector member 325. The connector member 320 connects the plunger 130 to the linear actuator 300. Bypass ports 335 permit fluid to flow through the connector member 325. In the arrangement shown in FIG. 1, the connector member 325 is connected to the armature 320. In this way, the armature 320 is able to directly impart the reciprocal movement needed by the plunger 130 in order to displace production fluids. Any means of connecting the pump 100 to the motor 300 may be employed, so long as reciprocal movement is imparted to the plunger 130.

The pump 100 also includes an inlet 140 and an outlet 150. The pump inlet 140 is disposed proximate to the bottom end of the plunger 130, while the pump outlet 150 is placed proximate to the top end of the plunger 130 below the connector member 325. Formation fluids flow into the bore 135 of the plunger 130 through the inlet port 140. Fluids then flow into the annulus 112 on the upstroke, and back out of the annulus 112 on the downstroke. From there, fluids exit the bore 135 of the plunger 130 through the outlet port 150. After leaving the bore 135 of the plunger 130, formation fluids are lifted upwardly through the production tubing 50 by positive displacement generated by the pump 100.

The inlet port 140 and the outlet port 150 each include a check valve 142, 152. In the preferred embodiments, a ball and seat valve are used for the respective check valves 142, 152. The check valve 152 at the pump outlet 150 is in its open position during the downstroke so as to allow fluids to flow therethrough; the check valve 152 is then closed during the upstroke for lifting those fluids. In contrast, the check valve 142 at the pump inlet 140 operates in the open position during the upstroke, and then is closed during the downstroke. In this way, production fluids are drawn up into the bore 135 of the plunger 130 through the opened inlet port 140 on the upstroke. Thus, the plunger 130 of the double-acting pump is charged during the upstroke rather than during the downstroke. Fluids are then expelled from the bore 135 of the plunger 130 and through the outlet port 150 on the downstroke, with the check valve 142 at the inlet port 140 closed.

Appropriate seals 154, 144 are preferably included with the upper 152 and lower 142 check valves. Seal 154 is shown in FIG. 2 providing a seal between the upper ball 152 and the plunger 130. Seal 144 is shown providing a seal between the lower ball 142 and the pump inlet 140. In this arrangement, the seals 154, 144 serve as the seats for the valves 152, 142.

In the configuration of pump 100 in FIGS. 1 and 2, a novel annulus 112 is defined between the plunger 130 and the surrounding housing 110. The annulus 112 is positioned between the upper and lower ends of the plunger 130. Fluid is exchanged in and out of the annulus 112 during the pumping cycles. To accomplish the novel pumping operation, the pump 100 utilizes the annular space 112 between the housing 110 of the pump 100 and the plunger 130. To this end, a piston 120 is connected to the outer surface of the plunger 130. Because the piston 120 is connected to the plunger 130, the piston 120 moves up and down with the upstroke and downstroke of the plunger 130. The piston 120 resides around the plunger 130 within the annular region 112. The interface between the piston 120 and the inner surface of the housing 110 is sealed by one or more piston seals 124. Thus, the piston 120 provides a seal within the annulus 112 to create alternating positive and negative pressures within the annulus 112 as the plunger 130 is reciprocated axially, i.e., down and up, respectively.

The annulus 112 is also sealed off by housing heads 180, 190, above and below the plunger 130, respectively. First, an upper housing head 18 within the annulus 112 proximate to the outlet 150. Second, a lower housing head 190 is disposed within the annulus 112 proximate to the inlet 140. The two housing heads are radially disposed about the plunger 130, but are connected to the inner surface of the housing 110. This means that the plunger 130 is able to move axially between the two housing heads 180, 190. The upper 180 and lower 190 housing heads thus create a chamber in which the piston 120 reciprocates.

The interface between the upper housing head 180 and the plunger 130 is sealed by one or more upper housing head seals 184. Likewise, the interface between the lower housing head 190 and the plunger 130 is sealed by one or more lower housing head seals 194.

One or more piston through-openings 126, such as a series of perforations, is placed in the plunger 130 between the piston 120 and the lower housing seal 144. The piston through-openings 126 provide a path of fluid communication between the bore 135 of the plunger 130 and the annulus 112. During the upstroke of the pump 100, the plunger 130 and its piston 120 are lifted, thereby pulling relative vacuum within the annulus 112 above the lower housing seal 144. Thus, during the upstroke, production fluids are drawn upward through the inlet 140 of the pump 100, through the piston through-openings 126, and into the annular region 112 between the plunger 130 and the housing 110. This fluid movement within the annulus 112 is seen by the arrows in FIG. 1. Then, during the downstroke, the piston 120 acts against the fluid in the annulus 112, forcing it back into the bore 135 of the plunger 130. This action causes the check valve 142 at the pump inlet 140 to close, and the check valve 152 at the pump outlet 150 to open. Formation fluids are then forced by positive displacement through the bore 135 of the plunger 130 and out of the pump 100, to be lifted upon the next upstroke. The cycle is repeated, causing fluids to be displaced during both the upstroke and the downstroke of the pump 100.

The portion of the annulus 114 above the piston 120 is in fluid communication with the wellbore 10. In this regard, one or more housing through-openings 116 are provided. The housing through-openings 116 in one aspect do not contribute to the displacement of fluids up the tubing 50; rather, the through-openings 116 are included in order to maintain ambient wellbore pressure above the piston 120. Any fluids that migrate into the annulus 114 above the piston 120 are simply expelled out of the annulus 114 on the upstroke of the plunger 130. Thus, the upper annular region 114 does no "work" in lifting fluids to the surface.

The upper housing through-openings 116 are placed near the upper housing head 180 and near the top of the upper annulus 114. This permits fluid to be expelled from the upper annular region 114 along the entire upstroke of the piston 120. Further, the piston through-openings 126 are placed near the piston 120. This configuration minimizes the potential for gas lock.

In order to maximize efficiency of the motor 300 and accompanying pump 100, it is preferred that the volume displaced by the piston 120 during the downstroke be equal to twice the volume of fluid that is displaced by the plunger 130 during the upstroke. In this manner, the displacement by the piston 120 will compensate for the negative displacement by the plunger piston 130, and additionally produce an equal amount of fluid during the downstroke. Therefore, the net displacement of the pump 100 can be equal amounts of fluid in both the upstroke and the downstroke. Those familiar with the art will recognize that if the pump is hydrostatically balanced, equal production of fluid during the upstroke and the downstroke implies that the amount of hydraulic work done by the pump 100 during each half of the cycle is equal. Therefore, the force required from the motor 300 to drive the pump 100 is equal in both directions (neglecting friction). This provides the greatest efficiency for the linear actuator, e.g., motor 300, because all of the force provided by the motor 300 to the hydrostatically balanced pump is used to produce hydraulic work rather than simply opposing a hydrostatic imbalance. Such a novel pump arrangement permits a greater volume of fluid to be pumped by the linear actuator or motor 300, and increases the efficiency of well production. The same conclusion can be drawn by analyzing the forces produced by differential pressure on the cross-sectional areas of the plunger 130 and the piston 120.

As can be seen, a positive displacement pump 100 has been provided that allows a first volume of fluid to be displaced upward within the production tubing 50 during the upstroke of the pump 100. In addition, the pump 100 allows a second volume of fluid to be displaced upward within the tubing 50 during the downstroke. Such a novel pump arrangement permits a greater volume of fluid to be pumped.

In the preferred embodiment, the pump 100 is hydrostatically balanced at all times. This is provided when the area of the piston 120 less the cross-sectional area of the plunger 130 is equal to twice the cross-sectional area of the plunger 130. The plunger 130 has a constant pressure differential pushing downward equal to the pump outlet pressure minus the pump inlet pressure. The piston 120 has exactly the same differential acting in the opposite direction on twice the area, only during the downstroke portion of the pump cycle. Mathematically, this implies that the net force on the plunger 130 will be equal to the cross-sectional area of the plunger 130 times the pressure differential regardless of whether the motion of the plunger 130 is up or down, but the direction of the force will be opposite the direction of the motion of the plunger 130 at all times. This is optimal in that all of the force provided by the pump 100 is used to produce hydraulic work rather than to oppose a hydrostatic bias. However, other embodiments of the reciprocating pump would permit a variance of the area ratio between the piston 120 and the plunger 130, though additional stresses would be placed on the motor 300 to overcome any pressure imbalance.

It is possible to use the same principle using a solid piston and flow channels and valving that are separate, but the shown embodiment is preferred because of its simplicity and the fact that this embodiment allows the channel 335 to be at the top of the pump outlet 150. Gas cannot be trapped in the top of the bore 135 and pump outlet 150; therefore, gas lock is avoided.

Figure 3:
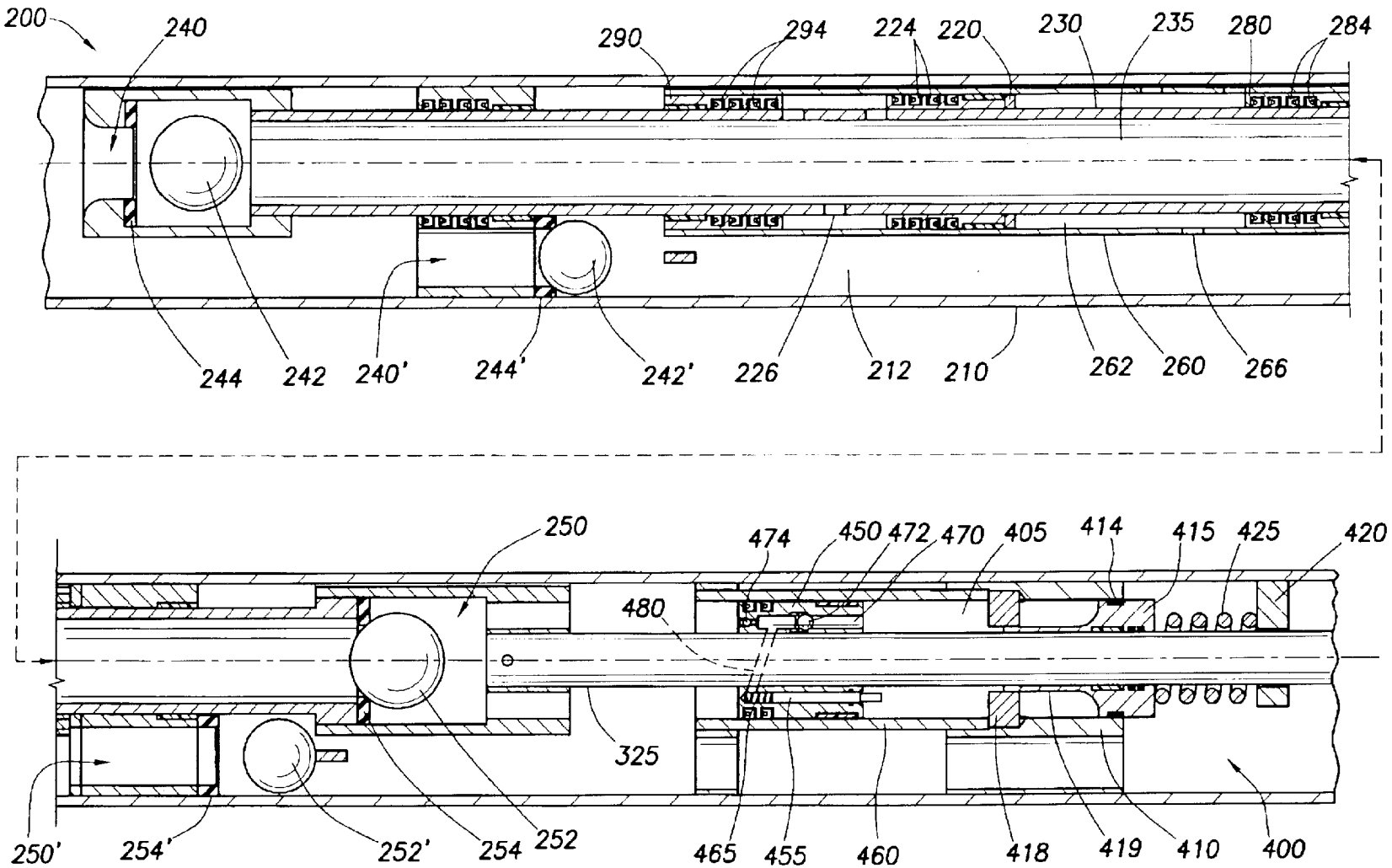
FIG. 3 illustrates a cross-sectional view of a second embodiment for a double-acting, reciprocating downhole pump. The pump has been bifurcated into two sections for a more detailed view.

Other arrangements for a double-acting, positive displacement pump are within the spirit and scope of the present invention. One such arrangement for a double-acting pump 200 is shown in FIG. 3. This second embodiment 200 shares a number of features with the first embodiment 100. First, a tubular piston 230 is again provided, with an elongated bore 235 being defined within the piston 230. A piston 220 is connected to the piston 230 and reciprocates with the piston 230. In addition, a pump inlet 240 and a pump outlet 250 are again provided at the lower and upper portions of the piston 230, respectively. Still further, lower 244 and upper 254 heads are again disposed outside of the piston 230, as in the first embodiment of FIG. 2. In addition, a housing 210 is also disposed around the piston 230 in order to form a housing annulus 212. As with housing 110, housing 210 defines an elongated tubular body having a bore therethrough.

However, there are additional features in the second embodiment 200 not found in the first pump 100. First, a sleeve 260 is provided outside of the pump piston 230. The sleeve 260 defines a tubular body nested between the housing 210 and the piston 230. This means that the housing annulus 212 is actually formed between the housing 210 and the sleeve 260. A separate annular region 262 is formed between the sleeve 260 and the piston 230 to form a sleeve annulus 262. Thus, a separate sleeve annulus 262 and housing annulus 212 are provided.

In the pump 100 of FIG. 2, upper 180 and lower 190 housing heads were provided in the housing annulus 112. Similarly, upper 280 and lower 290 heads are positioned in the pump 200 of FIG. 3. However, in pump 200, the upper 280 and lower 290 heads are positioned in the sleeve annulus 262 rather than in the housing annulus 212. Thus, the heads 280, 290 are sleeve heads rather than housing heads. As illustrated in FIG. 3, the upper 280 and the lower 290 heads includes one or more seals 284, 294, respectfully. The interface between the piston 220 and the inner surface of the sleeve 260 is sealed by one or more piston seals 224. Thus, the piston 220 provides a seal within the annulus 262 to create alternating positive and negative pressures within the sleeve annulus 262 as the piston 230 is reciprocated axially, i.e., down and up, respectively.

In the second pump embodiment 200, through-openings are selectively placed within the plunger 230 and the sleeve 260 to accomplish the desired paths of fluid flow. First, one or more plunger through-openings 226 is provided through the piston 230. The plunger through-openings 226 are disposed between the plunger 220 and the lower sleeve head 290. This provides a path of fluid communication between the bore 235 of the plunger 230 and the sleeve annulus 262. Second, one or more sleeve through-openings 266 is provided through the sleeve 260. The sleeve throughopenings 266 are disposed between the piston 220 and the upper sleeve head 280. In this manner, fluid communication is attained between the housing annulus 212 and the sleeve annulus 262.

A second pump inlet 240' and pump outlet 250' are provided in the housing annulus 212. The second pump inlet 240' is disposed in the housing 230 below the sleeve through-openings 266, while the second pump outlet 250' is placed in the housing 230 above the sleeve through-openings 266. Formation fluids flow into the housing annulus 212 outside of the sleeve 260 through the second inlet port 240'. Fluids then exit the housing annulus 212 through the second outlet port 250'. After leaving the housing annulus 212, formation fluids are lifted upwardly through the tubing 50 by positive displacement generated by the pump 100.

As with the first inlet 240 and outlet 250 ports, the second inlet 240' and outlet 250' ports each include a check valve 242', 252'. In the preferred embodiments, a ball and seat valve are once again used for the respective second check valves 242', 252'. However, both valves 242', 252' are stationary, or "standing," valves that open and close purely in response to pressure created from the action of the piston 220 within the sleeve annulus 262.

When the piston 220 is on the downstroke, negative pressure is created in the sleeve annulus 262 above the piston 220 and in the housing annulus 212. This causes the check valve 252' at the second pump outlet 250' to close. At the same time, this negative pressure causes the check valve 242' at the second pump inlet 240' to open, and draws production fluids into the pump 200 from the formation 25. When the piston 220 cycles back to the upstroke, the production fluids drawn into the sleeve annulus 262 are expelled back into the bore of the housing 210, i.e., the housing annulus 212. This positive pressure forces the second inlet valve 242' to close, and the second outlet valve 252' to open. In this way, production fluids are displaced from the housing 210 and up the production tubing 50 on the upstroke. Seals 244' and 254' serve as seats for the second pump inlet 240' and second pump outlet 250', respectively As can be seen with the second pump 200 arrangement, two possible flow paths have been provided for production fluids. The first path is taken through the first inlet 240; the second path is through the second pump inlet 240'. In either path, fluids are eventually joined above the first 250 and second 250' pump outlets for displacement up the tubing 50.

In the pump embodiment 200 of FIG. 3, the sleeve annulus 262 above the piston 220 is pressurized during the upstroke, such that fluid is pumped through the sleeve through-openings 262 and into the housing annulus 212. At the same time, fluid is allowed to flow through the opened check valve 252' at the second pump outlet 250'. While the sleeve annulus 262 is pressurized above the piston 220, the sleeve annulus 262 is depressurized below the piston 220, drawing production fluids through the piston through-openings 226 and into the sleeve annulus 262 below the piston 220.

During the downstroke, the sleeve annulus 262 is pressurized below the piston 220. This forces production fluids to flow out of the sleeve annulus 262 below the piston 220 via the plunger through-openings 226 and up through the check valve 252 at the first pump outlet 250 located at the upper end of the piston 230. The check valve 242 at the lower end of the piston 230 is forced to its closed position during this portion of the pumping cycle due to pressure buildup in the bore 235 of the piston 230. At the same time, the second outlet check valve 252' at the upper portion of the housing annulus 212 also closes, and the sleeve annulus 262 receives production fluids above the piston 220. In this manner, the sleeve annulus 262 above the piston 220 is pumping and the sleeve annulus 262 below the piston 220 is filling during half of the pump cycle, and the reverse is true during the other half, or phase, of the pump cycle.

It should be noted that the placement of the plunger through-openings 226 and the sleeve through-openings 266 as shown in FIG. 3 may be reversed. This means that one or more plunger through-openings 226 is provided through the plunger 230 between the piston 220 and the upper sleeve head 290. In turn, one or more sleeve through-openings 266 would be provided through the sleeve 260 between the piston 220 and the lower sleeve head 280. Reversing the placement of the plunger through-openings 226 and the sleeve through-openings 266 will cause the opening and closing of the check valves 242, 252, 242', 252' to be switched during operation of the pump 200. In this respect, the first inlet valve 242 would open in order to receive fluids on the plunger's 230 downstroke, with the first outlet valve 252 closing. On the upstroke of this alternate arrangement (not shown), the first inlet valve 242 would close as fluids are injected from the sleeve annulus 262 into the bore 235 of the plunger 230, while the first outlet valve 252 would be opened. In the housing annulus 212, the second inlet valve 242' would open on the plunger's 230 upstroke in order to receive production fluids, with the second outlet valve 252' closing. Then on the downstroke, the second inlet valve 242' would close as fluids are injected from the sleeve annulus 262 into the housing annulus 212, while the second outlet valve 252' opens.

In either of these two arrangements, the piston 230, sleeve 260 and housing 210 are preferably configured such that the pump 200 is able to pump equal volumes whether the piston 230 is moving up or down. Hence, the pump 200 is again "double-acting."

It is observed that during operation of the pump as disclosed in the embodiments 200 herein, pressure develops downwardly upon the pump 200. More specifically, the pump 200 becomes biased towards its downstroke due to the pump outlet 400 pressure acting on the cross-sectional area of the plunger 230 in response to a buildup of hydrostatic head. This, in turn, creates unnecessary stress upon the motor 300. Accordingly, an additional optional feature is incorporated into the second embodiment for the pump 200 which creates a counter-balancing upward force on the piston 230. A pressure balancing apparatus 400 is provided in order to balance the overall forces operating upon the pump 200 so that, in total, it is hydrostatically balanced.

The balancing apparatus is seen in the upper portion of FIG. 3 at 400. The balancing apparatus 400 first comprises a seal sleeve 460. The seal sleeve 460 defines a tubular body that receives the connector 325. The seal sleeve 460 is disposed above the first 252 and second 252' pump outlets.

Residing within the seal sleeve 460 is a balancing piston 450. The balancing piston 450 also defines a tubular body, and is nested between the seal sleeve 460 and the connector 325. The balancing piston 450 is substantially dimensioned in radius in accordance with the plunger 230.

As will be shown, the purpose of the seal sleeve 460 and the balancing piston 450 is to produce a force equal, but opposite in direction, to the inherent hydrostatic imbalance (in this embodiment) of the plunger 230. This is accomplished by evacuating most of the fluid from the seal sleeve 460 so that the balancing piston 450 is exposed to a relative vacuum on its upper surface continually during normal operation. The pressure on the lower side of the balancing piston 450 is equal to the pump outlet pressure. The pump outlet pressure minus the relative vacuum inside of the seal sleeve 460 produces a differential pressure acting on the cross-sectional area of the balancing piston 450, resulting in a net upward force capable of countering the hydrostatic imbalance of the plunger 230.

In order to evacuate pressure above the balancing piston 450, a seal housing 410 is first provided. The seal housing 410 defines a short tubular body that receives the connector 325 above the piston 230. In the arrangement shown in FIG. 3, the seal housing 410 is circumferentially disposed around the connector 325 between the motor (not shown) and the pump 200. The lower portion of the seal housing 410 receives a shoulder 418 having a restricted diameter. The shoulder 418 is disposed above the seal sleeve 460.

Second is a seal body 415 is provided. The seal body 415, referred to as a housing seal, is nested between the seal housing 410 and the connector 325. The housing seal 415 provides a seal between the seal housing 410 and the connector 325. At the same time, the housing seal 415 is permitted to move along the longitudinal axis of the seal housing 410. One or more seals, such as O-rings 414, are utilized on the perimeter of the housing seal 415 to create a seal at the interface between the housing seal 410 and the seal housing 410. The housing seal 415 includes a lower neck 419 that is received within the shoulder 418 of the seal housing 410 when the housing seal 415 moves downward.

The seal body 415 acts as a check valve so that nearly all of whatever fluid that might be within the seal sleeve 460 can be ejected into the production tubing 50 (proximate the first pump outlet 252) during the first upstroke. This occurs immediately after the pump 100 is first actuated. From that point forward, any downward movement of the connector 325 and the balancing piston 450 will cause a relative vacuum to occur in the sealing sleeve 460.

The area defined by the seal sleeve 460, the shoulder 418, and the balancing piston 450 defines a counterbalancing chamber 405. It is the purpose of the balancing apparatus 400 to create a vacuum within the counter-balancing chamber 405, thereby providing an upward force opposite the downward force caused by hydrostatic imbalance otherwise imposed on the pump 200 itself during pumping operations.

A plate 420 is provided proximate to the seal housing 410 opposite the piston 230. The plate 420 also receives the connector 325, though a sealed engagement is not necessary. A seal spring 425 is provided between the plate 420 and the housing seal 415. The seal spring 425 is maintained in compression, and serves to bias the housing seal 415 downward.

In operation, the plunger pump 455 is activated upon the first upstroke of the piston 230. As the piston 230 is lifted (via lifting of the connector 325), the balancing piston 450 is lifted with the connector 325. This, in turn, causes the volume within the counter-balancing chamber 405 to decrease, and the pressure therein to increase. As the balancing piston 450 approaches the shoulder 418 of the seal housing 410, the biasing force caused by the spring 425 acting against the housing seal 415 is overcome. The O-rings 414 upon the housing seal 415 release from the seal housing 410, and any fluid within the counter-balancing chamber 405 escapes past the housing seal 415 and up into the wellbore.

Upon downstroke, the balancing piston 450 moves downwardly with the piston 230, thereby expanding the volume and reducing the pressure within the counter-balancing chamber 405. This, in turn, relieves the pressure acting upon the housing seal 415, allowing the seal 415 to reseat within the seal housing 410. Resetting is accomplished in response to the action of the biasing force caused by the spring 425. A vacuum is then created within the counter-balancing chamber 405. This negative pressure, again, serves to act upwardly on the piston 230, providing an overall balancing of pressures upon the piston 230 and assisting the motor in reciprocating the piston 230 in the pump 200.

It is noted that the various seals around the connector 325, e.g., seals 414, do not provide a perfect fluid insulation downhole. This is particularly true in view of the harsh environment prevailing downhole. Therefore, it is expected that small amounts of fluid will invade the counter-balancing chamber 405 which, over time, could defeat the vacuum created therein. To avoid this circumstance, an optional fluid release mechanism is provided within the balancing piston 450 to allow fluids to escape.

The fluid release mechanism is in the form of a plunger-pump apparatus. The plunger pump apparatus is provided to help maintain the original vacuum produced by the seal housing 410 and the seal body 415. The plunger pump apparatus is housed inside the balancing piston 450. The plunger pump apparatus is comprised of a vacuum plunger 455, a plunger biasing spring 465. The plunger spring 465 serves to bias the plunger 455 in an extended position. The plunger pump apparatus also includes an inlet check valve 472, an outlet check valve 474, and various passages 480, 470, to allow flow of fluid through the plunger pump apparatus. The check valves 472, 474 are configured to permit fluid residing within the counterbalancing chamber 405 to exit through the balancing piston 450.

In operation, the plunger pump apparatus is first actuated on upstroke of the plunger 230. As the motor 300 and plunger 230 reach the upper limit of travel, the vacuum plunger 455 strikes the shoulder 418 at the upper end of the sealing sleeve 460. When the vacuum plunger 455 strikes the shoulder 418, it is forced downward, and compresses the volume in the passages between the inlet check valve 472 and the outlet check valve 474. The plunger spring 465 at the base of the plunger 455, which acts to bias the plunger 455 in its extended position, is also compressed. This, in turn, increases pressure within the through-opening 480, forcing fluid downward through outlet check valve 474. The upper check valve 472 is closed. Thus, the plunger pump is used to scavenge any fluid that may leak into the seal sleeve 460. This, in turn, maintains the vacuum that is needed for the best operation of the balancing piston 450.

Other means exist for providing a counter-balancing force upon the connector 325. In an alternate embodiment, not shown, a counter-balancing housing is extruded downwardly from the first pump inlet 130 below the piston. A sealed counter-balance chamber is created at the base of the piston. A separate fluid passage (not shown) is then extended upwardly in the wellbore outside of the piston, opening into the pump outlet above the sleeve 260. This places the bottom portion of the pump in fluid communication with the pump outlet pressure, thereby allowing the greater pressures prevailing above the piston to be diverted below the piston, and equalizing the upward and downward forces.

While the foregoing is directed to embodiments of the present invention, other and further embodiments of the invention may be devised without departing from the basic scope thereof. For example, the linear electric motor 300 may be placed below the pump 100 (of FIG. 2) rather than above the pump 100. This permits a larger size motor to be employed, as there is no need to leave a flow-channel for production fluids. In this arrangement, the connector member 325 is removed from the top of the pump 100 along with the motor 300. The top of the housing 110 is then connected directly to the tubing 50. The bottom of the housing 110 is extended below the pump inlet 140, and is connected to the stator 310 (or outer tubular member) of the motor 300. One or more ports (not shown) are placed in the pump inlet 140 to provide fluid communication between formation and the pump inlet 140.

The scope of the present invention is determined by the claims that follow.

What is claimed is:

1. A positive displacement pump within a wellbore for pumping fluids from a downhole formation to the earth's surface, the pump being reciprocated by a linear actuator, the pump comprising:

a plunger moving in response to reciprocal movement of the linear actuator to form an upstroke and a downstroke within the pump, and the pump being configured so as to pump a first volume of fluid upward within the wellbore during the pump's upstroke, and a second volume of fluid upward within the wellbore during the pump's downstroke;

a housing having a top end and a bottom end, and defining an elongated bore therein;

a sleeve having a top end and a bottom end, and defining an elongated bore therein, the sleeve being nested between the housing and the plunger so as to define a sleeve annulus between the plunger and the sleeve, and a housing annulus between the housing and the sleeve;

an upper sleeve head connected to the sleeve and sealing the sleeve annulus;

a lower sleeve head connected to the sleeve and sealing the sleeve annulus; and a piston connected to the plunger intermediate the upper sleeve head and the lower sleeve head, the piston residing within the sleeve annulus and reciprocating with the plunger.

2. The positive displacement pump of claim 1, wherein the first and second volumes of fluid are substantially equal.

3. The positive displacement pump of claim 1, wherein the plunger comprises a tubular body having a top end and a bottom end, and defining an elongated bore therein.

4. The positive displacement pump of claim 3, further comprising:

a first pump inlet disposed at a lower end of the plunger, the pump inlet having at least one lower check valve, the lower check valve being in its open position during the plunger's upstroke and in its closed position during the plunger's downstroke; and a first pump outlet disposed at an upper end of the plunger, the pump outlet having at least one upper check valve, the upper check valve being in its closed position during the plunger's upstroke and in its open position during the plunger's downstroke.

5. The positive displacement pump of claim 4, further comprising:

a second pump inlet for receiving production fluids into the housing annulus;

a second pump outlet through which production fluids exit the housing annulus;

one or more plunger perforations disposed within the plunger in order to form a path of fluid communication between the bore of the plunger and the sleeve annulus; and at least one sleeve through-opening within the sleeve through which production fluids are exchanged between the sleeve annulus and the housing annulus.

6. The positive displacement pump of claim wherein:

the second pump inlet is disposed proximal to the bottom end of the plunger, the second pump inlet having a lower check valve, the lower check valve being in its open position to receive fluids during the plungers downstroke, and being in its closed position during the plungers upstroke;

the second pump outlet is disposed proximal to the top end of the elongated plunger, the second pump outlet having an upper check valve, the upper check valve being in its open position to receive fluids during the plungers upstroke, and being in its closed position during the plungers downstroke;

the one or more plunger perforations are disposed between the piston and the lower sleeve head; and the at least one sleeve through-opening is disposed intermediate the piston and the upper sleeve head for establishing fluid communication between the bore of the sleeve and the housing annulus, such that fluids are received through the at least one sleeve through-opening and into the sleeve annulus during the plunger's downstroke, and fluids are expelled from the sleeve annulus through the at least one sleeve through-opening into the annulus of the housing during the plunger's upstroke.

7. The positive displacement pump of claim 6, wherein:

the first pump inlet is open during the plunger's upstroke;

the first pump outlet is open during the plunger's downstroke;

the second pump inlet is in fluid communication with the housing annulus, the second pump inlet being open during the plunger's downstroke; and the second pump outlet is in fluid communication with the housing annulus, the second pump outlet being open during the plunger's upstroke.

8. The positive displacement pump of claim 6, wherein the first and second volumes of fluid are substantially equal.

9. The positive displacement pump of claim 5, wherein:

the second pump inlet is disposed proximal to the bottom end of the plunger, the second pump inlet having a lower check valve, the lower check valve being in its closed position to receive fluids during the plunger's downstroke, and being in its open position during the plunger's upstroke;

the second pump outlet is disposed proximal to the top end of the elongated plunger, the second pump outlet having an upper check valve, the upper check valve being in its closed position to receive fluids during the plunger's upstroke, and being in its open position during the plunger's downstroke;

the one or more plunger perforations are disposed between the piston and the upper sleeve head; and the at least one sleeve through-opening is disposed intermediate the piston and the lower sleeve head for establishing fluid communication between the bore of the sleeve and the housing annulus, such that fluids are received through the at least one sleeve through-opening and into the sleeve annulus during the plunger's downstroke, and fluids are expelled from the sleeve annulus through the at least one sleeve through-opening into the annulus of the housing during the plunger's upstroke.

10. The positive displacement pump of claim 9, wherein:

the first pump inlet is open during the plungers downstroke;

the first pump outlet is open during the plungers upstroke;

the second pump inlet is in fluid communication with the housing annulus, and is open during the plungers upstroke; and the second pump outlet is in fluid communication with the housing annulus, and is open during the plunger's downstroke.

11. The positive displacement pump of claim 9, wherein the first and second volumes of fluid are substantially equal.

12. A positive displacement pump within a wellbore for pumping fluids from a downhole formation to the earth's surface, the pump comprising:

a housing having a top end and a bottom end, and defining an elongated bore therein;

a plunger nested within the housing through which fluids travel, the plunger having a top end and a bottom end and an elongated bore defined therein, the plunger moving in response to reciprocal movement of the linear actuator to form an upstroke and a downstroke within the pump so as to displace a first volume of fluid upward within the wellbore during the pump's upstroke, and a second volume of fluid upward within the wellbore during the pump's downstroke;

a housing annulus defined between the plunger and the housing;

a pump inlet proximal to the bottom end of the plunger, the pump inlet having a lower check valve, the lower check valve being in its open position during the plunger's upstroke, and being in its closed position during the plunger's downstroke;

a pump outlet proximal to the top end of the plunger, the pump outlet having an upper check valve, the upper check valve being in its closed position during the plunger's upstroke, and being in its open position during the plunger's downstroke;

an upper housing head connected to the housing and sealing the annulus;

a lower housing head connected to the housing and sealing the annulus;

a piston connected to the plunger and residing within the annulus intermediate the upper housing head and the lower housing head, the piston reciprocating with the plunger; and at least one plunger through-opening within the plunger intermediate the piston and the lower housing head for establishing fluid communication between the bore of the piston and the annulus, such that fluids are received through the at least one plunger through-opening and into the annulus during the plunger's upstroke, and fluids are expelled from the annulus through the at least one plunger through-opening into the bore of the plunger during the plungers downstroke.

13. The positive displacement pump of claim 12, wherein the first and second volumes of fluid are substantially equal.

14. A positive displacement pump within a wellbore for pumping fluids from a downhole formation to the earth's surface, the pump being reciprocated by a linear actuator to impart an upstroke and a downstroke, the pump comprising:

a housing having a top end and a bottom end, and defining an elongated bore therein;

a plunger nested within the housing through which fluids travel, the plunger having a top end and a bottom end and an elongated bore defined therein, the plunger moving in response to reciprocal movement of the linear actuator to form an upstroke and a downstroke within the pump so as to pump a first volume of fluid upward within the wellbore during the pump's upstroke, and a second volume of fluid upward within the wellbore during the pump's downstroke;

a sleeve having a top end and a bottom end, and defining an elongated bore therein, the sleeve being nested between the housing and the plunger so as to define a sleeve annulus between the plunger and the sleeve, and a housing annulus between the housing and the sleeve;

a first pump outlet proximal to the top end of the plunger, the first pump outlet having an upper check valve, the upper check valve being in its closed position during the plungers upstroke, and being in its open position during the plunger's downstroke;

a first pump inlet proximal to the bottom end of the plunger, the first pump outlet having a lower check valve, the lower check valve being in its open position during the plunger's downstroke, and being in its closed position during the plunger's upstroke;

an upper sleeve head connected to the sleeve and sealing the sleeve annulus;

a lower sleeve head connected to the sleeve and sealing the sleeve annulus;

a piston connected to the plunger and residing within the sleeve annulus intermediate the upper sleeves head and the lower sleeve head, the piston reciprocating with the plunger;

at least one plunger through-opening within the plunger intermediate the piston and the lower sleeve head for establishing fluid communication between the bore of the plunger and the sleeve annulus, such that fluids are received through the at least one plunger through-opening and into the sleeve annulus during the plunger's upstroke, and fluids are expelled from the sleeve annulus through the at least one plunger through-opening into the bore of the plunger during the plunger's downstroke;

a second pump inlet proximal to the bottom end of the plunger, the second pump inlet having a lower check valve, the lower check valve being in its open position to receive fluids into the housing annulus during the plunger's downstroke, and being in its closed position during the plunger's upstroke;

a second pump outlet proximal to the top end of the elongated plunger, the second pump outlet having an upper check valve, the upper check valve being in its open position to expel fluids from the housing annulus during the plunger's upstroke, and being in its closed position during the plunger's downstroke; and at least one sleeve through-opening within the sleeve intermediate the piston and the upper sleeve head for establishing fluid communication between the bore of the sleeve and the housing annulus, such that fluids are received through the at least one sleeve through-opening and into the sleeve annulus during the plunger's downstroke, and fluids are expelled from the sleeve annulus through the at least one sleeve through-opening into the annulus of the housing during the plunger's upstroke.

15. The positive displacement pump of claim 14, wherein the first and second volumes of fluid are substantially equal.

16. The positive displacement pump of claim 14, further comprising:

an elongated connector having a first end and a second end, the first end of the connector being connected to the linear actuator, and the second end being connected to the top end of the plunger to impart reciprocating motion; and a pressure balancing apparatus disposed around the connector to counter-balance any downward pressure upon the positive displacement pump created during pumping.

17. The positive displacement pump of claim 16, wherein the pressure balancing apparatus comprises:

a seal housing;

a seal body residing within the seal housing, the seal body being axially movable along the longitudinal axis of the seal housing, but being biased in a downward position;

a plunger pump circumferentially engaging the connector intermediate the seal housing and the plunger;

a pressure-balancing chamber defined by the seal housing, the seal body, and plunger pump, the pressure-balancing chamber experiencing an increase in pressure during pumping operations that acts against the seal body in order to overcome the bias in the seal body at a selected pressure, the seal body releasing pressure upon a designated upward movement within the seal housing.

18. The positive displacement pump of claim 17, wherein the pressure balancing apparatus further comprises:

a plate proximal to the seal housing opposite the plunger;

a spring held in compression between the plate and the seal body so as to bias the seal body downward; and a shoulder below the seal body to serve as a stop-member for downward movement of the seal body.

19. The positive displacement pump of claim 18, wherein the plunger pump of the pressure balancing apparatus defines a tubular body, and wherein the plunger pump further comprises:

a plunger;

a plunger spring for biasing the plunger upward;

a through-opening for placing the first pump outlet and the pressure-balancing chamber in fluid communication;

a through-opening check valve in the through-opening permitting fluid to flow into the pressure balancing chamber;

a channel for placing the through-opening and the plunger spring in fluid communication; and a channel check valve permitting fluid to flow from the pressure balancing chamber up the wellbore.

20. A positive displacement pump for use in a wellbore, the pump comprising:

a plunger movable in response to reciprocal movement of a linear actuator to form an upstroke and a downstroke within the pump, wherein a first volume of fluid is displaced upward within the wellbore during the upstroke and a second volume of fluid is displaced upward within the wellbore during the downstroke;

an annulus formed between a tubular housing and the plunger, the annulus defined at an upper end by an upper housing head and defined at the lower end by a lower housing head; and a piston operatively attached to the plunger intermediate the upper housing head and lower housing head, the piston displacing a portion of the second volume of fluid from the annulus during the downstroke.

21. A positive displacement pump within a wellbore for pumping fluids from a downhole formation to the earth's surface, the pump being reciprocated by a linear actuator, the pump comprising:

a plunger moving in response to reciprocal movement of the linear actuator to form an upstroke and a downstroke within the pump, and the pump being configured so as to pump a first volume of fluid upward within the wellbore during the pump's upstroke, and a second volume of fluid upward within the wellbore from a variable annulus formed between a tubular housing and the plunger during the pump's downstroke;

an upper housing head connected to the housing, sealing the annulus;

an lower housing head connected to the housing, also sealing the annulus; and a piston is connected to the plunger intermediate the upper housing head and the lower housing head.

22. The positive displacement pump of claim 21, wherein the first and second volumes of fluid are substantially equal.

23. The positive displacement pump of claim 21, wherein the plunger comprises a tubular body having a top end and a bottom end, and defining an elongated bore therein.

24. The positive displacement pump of claim 23, further comprising:

a first pump inlet disposed at a lower end of the plunger, the pump inlet having at least one lower check valve, the lower check valve being in its open position during the plunger's upstroke and in its closed position during the plunger's downstroke; and a first pump outlet disposed at an upper end of the plunger, the pump outlet having at least one upper check valve, the upper check valve being in its closed position during the plunger's upstroke and in its open position during the plunger's downstroke.

25. The positive displacement pump of claim 24, wherein the plunger further comprises the piston connected to the plunger intermediate the pump inlet and the pump outlet.

26. The positive displacement pump of claim 25, further comprising one or more plunger perforations disposed within the plunger between the piston and the lower housing head in order to form a path of fluid communication between the bore of the plunger and the annulus.

27. The positive displacement pump of claim 26, wherein the first and second volumes of fluid are substantially equal.

28. A positive displacement pump within a wellbore for pumping fluids from a downhole formation to the earth's surface, the pump being reciprocated by a linear actuator, the pump comprising:

a plunger moving in response to reciprocal movement of the linear actuator to form an upstroke and a downstroke within the pump, and the pump being configured so as to pump a first volume of fluid upward within the wellbore during the pump's upstroke, and a second volume of fluid upward within the wellbore during the pump's downstroke, wherein the plunger comprises a tubular body having a top end and a bottom end, and defining an elongated bore therein; and a pressure balancing apparatus to counter-balance downward pressure upon the positive displacement pump created by the hydrostatic head during pumping.

* * * * *

UNITED STATES PATENT AND TRADEMARK OFFICE

CERTIFICATE OF CORRECTION

PATENT NO. : 6,817,409 B2
APPLICATION NO. : 10/167622
DATED : November 16, 2004
INVENTOR(S) : William F. Howard It is certified that error appears in the above-identified patent and that said Letters Patent is hereby corrected as shown below:

In the Claims section, column 14, claim 6, line 27:

Please insert "5" after the word "claim."

Signed and Sealed this

Twenty-ninth Day of August, 2006

JON W. DUDAS
*Director of the United States Patent and Trademark Office*